United States Patent [19]

Huston

[11] 4,113,253

[45] Sep. 12, 1978

[54] AMUSEMENT DEVICE REQUIRING CONCENTRATION AND COORDINATION

[75] Inventor: Henry H. Huston, Burlington, Vt.

[73] Assignee: Weird Products Ltd., Vt.

[21] Appl. No.: 774,372

[22] Filed: Mar. 4, 1977

[51] Int. Cl.[2] ..... A63B 65/12

[52] U.S. Cl. ..... 273/96 R; 124/5; 272/67

[58] Field of Search ..... 273/96 R, 97 R, 98, 273/95 R, 1 R; 124/5; 272/67, 93

[56] References Cited

U.S. PATENT DOCUMENTS

| | | | |
|---|---|---|---|
| 1,530,573 | 3/1925 | Olcott | 273/96 R |
| 4,039,186 | 8/1977 | Anderson | 273/97 R X |

FOREIGN PATENT DOCUMENTS

| | | | |
|---|---|---|---|
| 10,795 of | 1897 | United Kingdom | 273/96 R |
| 143,713 | 6/1920 | United Kingdom | 273/97 R |

*Primary Examiner*—William H. Grieb

*Attorney, Agent, or Firm*—Brooks, Haidt, Haffner & Delahunty

[57] ABSTRACT

A small object, such as a marble, is held in a receptacle secured at one end of an elongated rod of springy material. Because of the flexibility of the rod, transferring the object to the receptacle of one rod from that of another is frustrated by the flexing of the rods imparting a wobbling and bouncing motion to the receptacles. The rod preferably has a handle at the end opposite the receptacle for safety and easy gripping. The rod can be a thin flexible metal member with a handle of wood and the receptacle is preferably a wood block with a round central well.

14 Claims, 4 Drawing Figures

Fig. 1.
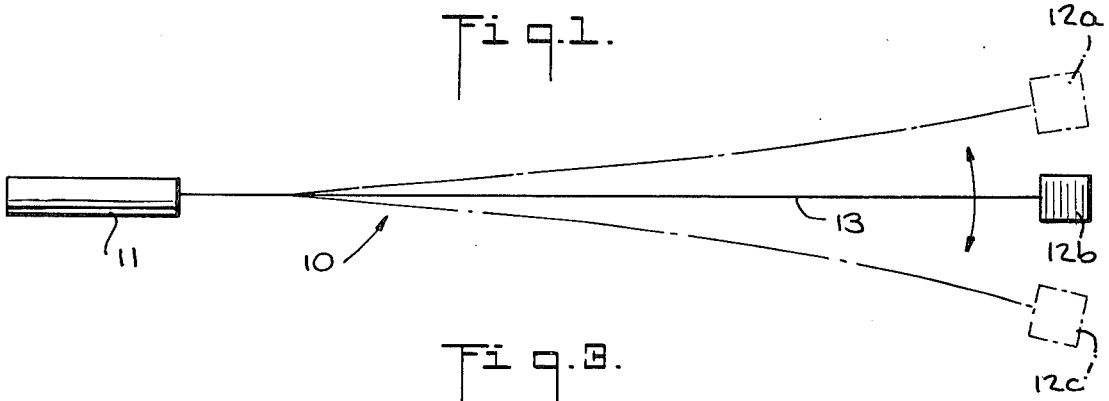
Fig. 3.
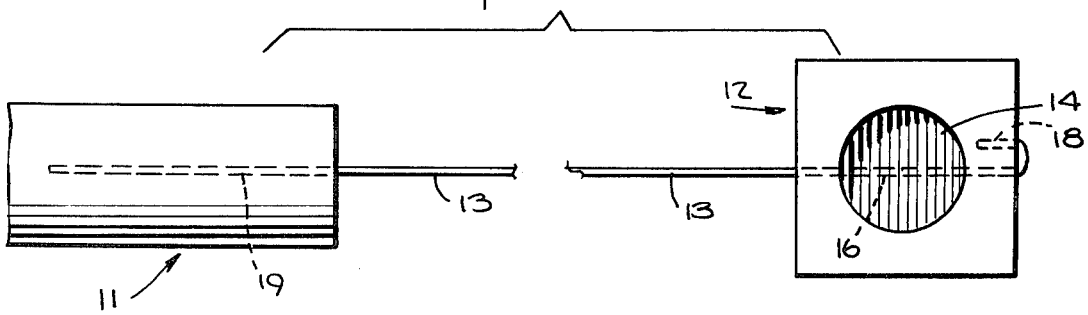
Fig. 2.
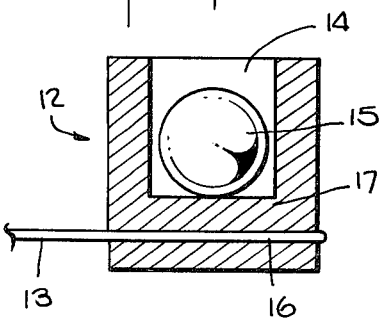
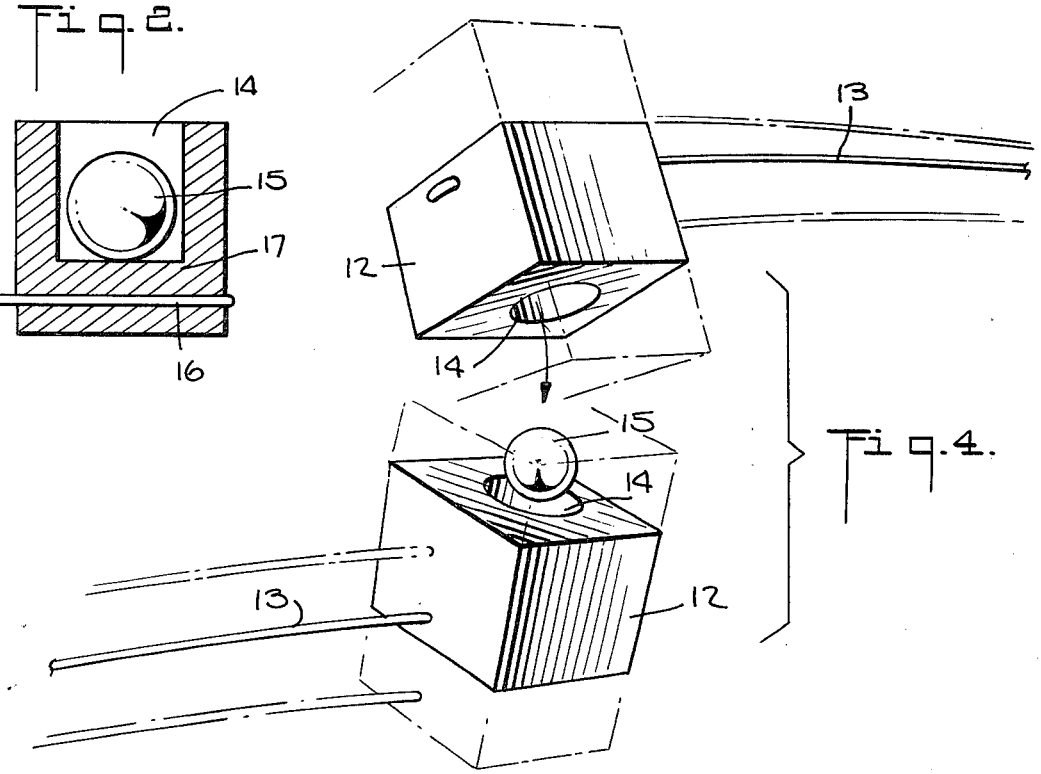
Fig. 4.

AMUSEMENT DEVICE REQUIRING CONCENTRATION AND COORDINATION

BACKGROUND OF THE INVENTION

1. Field of the Invention

The invention relates to toys and games, and more particularly to a game device requiring coordination and dexterity.

2. Description of the Prior Art

Games that challenge the concentration and coordination have been popular from time immemorial. Balancing games, such as jackstraws, involve a test of concentration under tension, and reward the player whose skill prevails while challenging the player to more difficult feats. The well known egg and spoon race wherein one player must pass an egg from his spoon to a spoon held by a teamate, adds the element of cooperation to the test of individual concentration and coordination. There is always a popular demand for simple and inexpensive, yet challenging, game devices. To avoid boredom while training coordination, games are frequently used in modern physical therapy and rehabilitative programs.

SUMMARY OF THE INVENTION

A receptacle attached to one end of an elongated flexible and springy rod has a recess for receiving and holding an article, such as a small ball or marble. A player holding the rod by its other end, remote from the receptacle, attempts to manipulate the receptacle to transfer the article to or from its recess from or to the receptacle at the end of another, similarly held rod. While the player is trying to maneuver the receptacle, the flexibility and springiness of the wire makes the task quite difficult. In one game played with the device of the invention, two players attempt to pass a small ball or marble from the receptacle of the device held by one player to the receptacle of another of the devices held by the other player, requiring coordination of the players' efforts to achieve success.

The device can be used to detect perceptual disabilities, particularly in children and adolescents, and may be useful in certain kinds of therapy for perceptual and hearing disabilities.

The rod upon which the receptacle is mounted is sufficiently long and springy to permit the receptacle to swing and sway widely about an imaginary axis extending from the centerline of the portion of the rod gripped by the player. The weight of the receptacle causes the rod to bend downward, and the rod bends further when there is an object in the receptacle.

The length of the rod as a lever arm, multiplies the amplitude of angular movements by the player, and the combined result is a tendency of the receptacle to move unpredictably away from the position intended by the player. Preferably the rod is sufficiently elastic to fully recover without permanent deformation, from flexing to an extent considerably greater than the normally to be anticipated swings of say, 30° or more as will occur during play.

When a ball or marble is in a receptacle of the device and is to be transferred to a receptacle of a device held by another player, the rod and receptacle must be turned over to "pour out" the ball or marble, requiring very careful control by the players to effect the transfer.

In a preferred embodiment of the device, the total length of the rod is slightly over three feet, and the receptacle is a wooden block formed as a cube about one inch by one inch with a central cylindrical well about ⅝ inch in diameter and about ⅝ inch deep, to hold a marble about ½ in in diameter. The springy rod is preferably formed of metal such as copper or brass, about 1/16 inch in diameter, having sufficient flexibility such that it will dip under the effect of gravity a distance of about one foot below the horizontal under the weight of the wood block alone when the opposite end of the rod is held level and horizontal. Preferably the end of the rod opposite the receptacle end is fitted with a generally cylindrical handle, which can be about 4 inches long and ⅝ inch thick, from which the rod extends axially. The handle can be formed of the same wood as the wood block.

The handle and receptacle can, of course, take other forms and be made of other materials such as synthetic plastics or fiberglass or metal. The receptacle may, for example be formed as a cup, and the handle could have ridges or grooves for gripping.

In the preferred embodiment, wherein the receptacle is cube shaped, the rod is secured on the vertical centerline, but below the horizontal center on one side of the cube face, considered when the receptacle recess opening faces upwardly.

In the presently preferred manner of attaching a wood block receptacle to the springy rod, the rod extends through the block directly below the bottom of the recess or well therein from one face of the block to the other, with a return bend at the rod end re-entering the distal face of the block and preventing relative pivotal movement of the block on the rod. The rod could of course be glued or otherwise secured to the block, and depending on the material used in construction of the device, other securing means can be employed.

Variations on the basic marble passing game will readily suggest themselves to users of the game device, and those who master the simpler tricks can go on to still more challenging feats. Modified versions of the device having shorter lengths of flexible rod can be used to learn the basic skills involved before attempting play with rods a yard or more long, because the wobbling motion is amplified in proportion to the rod length. Sets of rods of different length can be provided with interchangeable handles and receptacles if desired for a graduated increase in difficulty.

These and other features of the invention will be more fully understood from the following detailed description of a preferred embodiment of the invention, especially when that description is read with reference to the accompanying figures of the drawings.

BRIEF DESCRIPTION OF THE DRAWINGS

In the drawings, in which like reference characters designate like parts throughout:

FIG. 1 is a side view of the device of the invention showing how the device can move in use;

FIG. 2 is an enlarged detail view in vertical section of a receptacle of the device with a marble therein;

FIG. 3 is a similarly enlarged and partially broken away top view of the device with hidden parts shown in dashed lines; and FIG. 4 is a detail view in perspective of a passing maneuver transferring a marble from one receptacle to another in one type of play with the device of the invention.

DETAILED DESCRIPTION OF A PREFERRED EMBODIMENT

The device generally designated by reference numeral 10 in FIG. 1 has a cylindrical handle 11 connected to a receptacle 12 by an elongated flexible rod 13. The rod 13 is springy, and the positions of the receptacle 12 shown at 12*a*, 12*b* and 12*c* indicate how the receptacle 12 can swing up and down in the direction of the arrows while the handle 11 is held substantially horizontal. Of course the rod 13 and receptacle 12 will swing from side to side as well.

In the presently particularly preferred embodiment of the invention, the device 10 has a total length of about 39 inches. It is preferred that the rod 13 be sufficiently flexible to dip about one foot below the horizontal under the weight of the receptacle 12 alone while the handle 11 is held horizontally. The rod 13 is preferably of copper or brass and about one-sixteenth inch in diameter for a combination of the desired springiness with durability and attractive appearance. TENS AIM liquid finish hard drawn 125,000 p.s.i. wire available from Atlantic Wire Co., is particularly suitable. The handle 11 is preferably a cylinder of wood sized to enable a player to easily grasp the handle 11, and should of course be smooth and splinter free. The preferred dimensions for the handle are about 3 to 6 inches long and about ½ inch to one inch in diameter. A handle four inches long and about ⅝ inch in diameter is particularly preferred.

The rod 13, handle 11 and receptacle 12 can be made from other materials. For example, the rod 13 can be of a flexible metal other than copper or brass, or of synthetic plastic material or fiberglass, and the handle and receptacle, or either of them, can be of plastic, or rubber.

FIG. 2 shows the preferred form of receptacle 12, formed from a wood block as a cube of about one inch measured along each edge with a central cylindrical well 14, which is about ⅝ inch deep and about ⅝ inch in diameter, to receive a preferably spherical object such as the glass marble 15 shown. The rod 13 is shown in FIGS. 2 and 3 to have its end portion 16 passing through a base portion 17 of the receptacle 12 beneath the well 14. There is a return bent end 18 of the rod re-entering the receptacle 12 to secure the receptacle 12 firmly to the rod 13, but some other attachment means such as glue can be substituted for the arrangement illustrated. The fact that the rod 13 is attached to the receptacle 12 below the horizontal center line of the receptacle 12 enhances difficulty in maneuvering the receptacle 12. When the device 10 is made with the preferred materials and dimensions, its total weight is about 1 ounce or less, most of the weight being in the handle 11 and receptacle 12.

FIG. 3 also shows how to handle end portion 19 of the rod 13 is fitted into the handle 11 along the handle axis. An adhesive or a press fit can be used in securing the portion 19 in place, or the handle 11 could have the rod 13 attached in manner similar to the attachment of the receptacle 12 to the rod 13.

In the preferred embodiment of the device 10, the rod 13 is sufficiently springy that the receptacle 12 can move and return over a very large included angle extending on either side of the axis of the handle 11 without permanent deformation of the rod 13, in response to movement imparted at its handle, e.g. an included angle greater than substantially 90°. In ordinary game playing, the rod 13 may be expected to bend or flex through angles of 30° and more even when such flexing and bending is not intended by the player.

FIG. 4 shows how an object such as the marble 15 can be "poured" from one receptacle 12 to another in one game that can be played with a pair of the devices 10 by two players. It will be noted that the receptacles 12 may come into contact with each other and such contacts may either aid or hamper an attempted passing of the marble 15 therebetween. Of course the device 10 whose receptacle 12 holds a marble 15 or other object bends more under the influence of gravity than the device 10 with the receptacle empty, making transfer more difficult.

It has been found to be somewhat less difficult for one player to pass an object from the receptacle 12 of a device 10 held in one of his hands to a device 10 held in his other hand than for two players to pass an object between them, so solo games and practice can serve either as training for team games, or as physical therapy. In another game, a player might attempt to transfer a marble to a fixed receptacle, such as a cup, Preferably the device 10 is made of attractive materials such as the copper or brass and wood mentioned, and even when devices 10 are not in use for game playing they can be hung as interesting mobile structures or the like. Choices of materials, and dimensions, and amusement and training uses of the device 10 will suggest themselves and are considered within the spirit and scope of the invention.

What is claimed is:

1. An amusement device comprising an elongated normally straight rod of springy material with a receptacle for receiving a ball or the like attached at one end and elongated handle means attached at the other end of the rod, said rod being substantially longer than said handle means and sufficiently flexible such that said rod and receptacle swing in oscillating manner through angles in any direction relative to the axis of elongation of said handle, including up and down and from side to side, in response to slight movement imparted to said handle when gripped by the hand.

2. The device of claim 1 wherein said rod is made of normally straight metal wire, and said receptacle is sized to receive a marble-like ball.

3. The device of claim 1 wherein said receptacle is generally cube-shaped and encompasses a ball receiving well which is open only at one face of said cube shape adjacent to a face at which said rod enters said cube shape.

4. The device of claim 1 wherein said rod is of metal and said handle and receptacle are of wood.

5. The device of claim 1 wherein said rod is of sufficient length and flexibility for said receptacle to swing through included angles greater than substantially 90° in any direction with respect to said axis of the handle in response to movement imparted at its said handle end without permanent deformation of the rod.

6. The device of claim 1 wherein said receptacle comprises means defining a generally cylindrical upwardly opening well, and said rod passes through said receptacle at a location below said well entering substantially along an axial plane passing through the vertical centerline thereof and having a return bent portion re-entering substantially at the opposite side of said receptacle.

7. The device of claim 1 wherein said rod has length greater than about 3 feet, and said receptacle is a wooden cube about one cubic inch in volume encompassing a cylindrical well, the weight of said receptacle and the springiness of said rod being so related that said receptacle dips about one foot below horizontal under its own weight when the handle is held horizontal.

8. In combination, a pair of amusement devices each comprising an elongated springy rod having a handle at one end and a receptacle at an opposite rod end, said rod being sufficiently flexible such that said rod and receptacle swing in oscillating manner through angles in any direction relative to an axis of said handle, including up and down and from side to side, in response to slight movement imparted to said handle when gripped by the hand, and a spherical object sized to fit within said receptacle for playing a game involving transferring the spherical object from said receptacle of one amusement device to said receptacle of another.

9. The combination of claim 8 wherein each device has a total length of more than three feet, said rod is of metal, and each of said handle and said receptacle is of wood.

10. A method of playing a game comprising manually grasping a handle from which an elongated, normally straight flexible rod extends, said rod terminating in a receptacle releasably holding an object, holding said handle and rod such that the rod extends substantially horizontally and said rod and receptacle swing in oscillating manner through angles in any direction, including up and down and from side to side, in response to slight movements of said handle, and attempting to transfer the object from said receptacle to another receptacle.

11. The method of claim 10 wherein said other receptacle is also at the end of an elongated flexible rod whose handle is manually grasped in similar manner.

12. The method of claim 11 wherein both handles are grasped by the same player.

13. The method of claim 11 wherein each handle is grasped by a different player.

14. A method of training muscular coordination comprising manually grasping a handle from which an elongated, normally straight flexible rod extends, said rod terminating in a receptacle releasably holding an object, holding said handle and rod such that the rod extends substantially horizontally and said rod and receptacle swing in oscillating manner through angles in any direction, including up and down and from side to side, in response to slight movements of said handle, and attempting to transfer the object from said receptacle to another receptacle.

* * * * *